United States Patent [19]

Mantegani

[11] 4,193,761

[45] Mar. 18, 1980

[54] KILN

[76] Inventor: Enzo Mantegani, Via Clusone 2, Milano, Italy

[21] Appl. No.: 947,177

[22] Filed: Sep. 29, 1978

[30] Foreign Application Priority Data

Oct. 7, 1977 [IT] Italy ..... 28362 A/77
Jul. 10, 1978 [IT] Italy ..... 25490 A/78

[51] Int. Cl.[2] ..... F27B 9/20

[52] U.S. Cl. ..... 432/128; 432/169; 432/148; 432/249

[58] Field of Search ..... 432/128, 144, 148, 146, 432/161, 166, 169, 192, 194, 207, 208, 249, 242, 152; 34/209, 210, 215, 216, 242

[56] References Cited

U.S. PATENT DOCUMENTS

| | | | |
|---|---|---|---|
| 3,328,861 | 7/1967 | Dressler | 432/148 |
| 3,388,439 | 6/1968 | Tomkins | 432/148 |
| 3,904,355 | 9/1975 | Takahashi | 432/144 |
| 3,972,127 | 8/1976 | Hoshi et al. | 34/242 |
| 4,035,142 | 7/1977 | Hatzenbichler et al. | 432/249 |

*Primary Examiner*—Henry C. Yuen
*Attorney, Agent, or Firm*—Michael J. Striker

[57] ABSTRACT

A kiln includes a hollow housing which has an upper and lower wall, an inlet and outlet. The lower wall of the housing is provided with a first set of baffles spaced from one another along the length of the housing and extending towards the upper wall of the housing. The upper wall of the housing is provided with a second set of baffles spaced from one another along the length of the housing and extending towards the lower wall. The first and second sets of baffles bound betweem them a gap defining a transport path for items to be treated. At least one set of baffles is adjustable so as to vary the width of the gap.

11 Claims, 5 Drawing Figures

KILN

BACKGROUND OF THE INVENTION

The present invention relates to kilns.

More particularly the invention concerns a roller kiln for baking ceramic or refractory material.

Roller kilns for ceramic or refractory material are rather well known in the art. Usually such a kiln comprises a housing having a long tunnel through which the material to be treated in the kiln is transported. The transport means as a rule comprise a plurality of rotatable rollers disposed one after another and transversely to the length of the tunnel. Usually the rollers are located somewhere between the upper and lower walls of the housing. It is also known to provide the upper and lower walls of the kiln with a plurality of baffles which are fixedly mounted on the walls and extend towards the corresponding opposite wall. The corresponding opposite baffles on the opposite walls are so arranged as to define a gap between them which serves as a transport path for the items to be treated. These opposite baffles compel the hot gas to engage the items to be treated more effectively between the two opposite baffles.

Such kilns have a disadvantage which resides in the fact that the baffles are fixed, that is can not be adjusted, on the walls. Due to this fact the characteristics of the gas between two opposite baffles are the same regardless of the different thickness, composition and other factors the items to be treated may have. Thus, it is to be understood that the best treatment is available only for a few types of material, while the others most likely will not be given an adequate treatment.

Moreover, it is known that the kiln usually has several compartments of treatment, such as for example a pre-heating step, a degassing step, a baking step, a cooling step, etc. Usually these steps operate with completely different temperature, and many other factors. It has been noticed that the known kilns are not satisfactory with regard to controlling and ajusting the above-mentioned steps. The problem exists due to a certain temperature inertia which occurs between two adjacent steps which operate completely different temperature processes.

There have been attempts to gradually change the temperature of different steps. However, such a solution results in unduly lengthening the kiln or slowing down the transportation speed of the items to be treated. In both cases the result was undesirably highly expensive.

SUMMARY OF THE INVENTION

It is a general object of the present invention to avoid the disadvantages of the prior art kilns.

More particularly, it is an object of the present invention to provide such a kiln which would permit adjusting the gas stream for treatment of the items to adequately correspond to the particular kind of material of the items to be treated.

Another object of the present invention is to provide such a kiln which would render it possible to maintain relatively great differences in the temperatures between adjacent sections of the kiln and still to avoid the undesired mutual influence between the adjacent sections.

In pursuance of these objects and others which will become apparent hereafter, one feature of the present invention resides in providing a kiln comprising a hollow elongated housing having an upper wall and a lower wall spaced from each other defining therebetween the interior of the housing, an inlet for inserting items to be treated in said housing and an outlet for withdrawing the treated items from the housing. The lower wall of the housing is provided with a first set of baffles spaced from one another along the length of the housing and extending towards the upper wall thereof. A second set of baffles spaced from one another along the length of the housing is mounted on the upper wall of the housing and extends towards the lower wall of the housing. The first and second sets of the baffles bound between them a gap extending along the length of the housing. The gap defines a transport path for the items to be treated. One of the main advantageous features of the present invention resides in the fact that at least one set of baffles is adjustable so as to vary the width of the gap to accommodate the hot gas therein to better correspond to the different factors of the actual items to be treated. The housing is further provided with means for transporting the items through the gap from the inlet to the outlet of the housing.

In accordance with another advantageous feature of the present invention the two adjacent sectors of the kiln which operate at different temperatures are separated from each other by at least a doubled row of baffles, thus preventing mutual influence of the adjacent sectors. These doubled baffles are also spaced from one another by a narrow clearance sufficient to create between them an intermediate chamber. This renders it possible to considerably limit the temperature inertia and as a result it becomes possible to maintain the desired sudden temperature variations between different sectors of the kiln without any undesired lengthening of the kiln or slowing down the transport speed of the items to be treated. On the contrary, it becomes possible to considerably minimize the treatment time and shorten the kiln, which leads to considerable fuel or electric power savings.

The adjustment of the baffles by means of vertical displacement, also allows one to very quickly replace the baffles if necessary. In this context it is to be mentioned that the baffles are subject to very fast wear, and therefore the task of replacing the baffles becomes very significant. This is true especially when one considers the fact that, in prior art kilns, in order to change the baffles, it was necessary to dismount some bricks of the upper wall of the kiln. Needless to say, such an operation is very complicated and expensive. On the other hand, in accordance with the present invention, the baffles-replacement is a very easy and simple operation which does not involve dismounting said bricks.

Moreover, this feature at the same time permits one to employ the baffles of either solid or soft refractory material (for example refractory fibers) regardless of whether the upper wall of the kiln is suspended or not.

In accordance with still another advantageous feature of the present invention, the wall of the housing which receives the adjustable set of baffles (or both walls if both sets are adjustable) is provided with throughgoing holes each receiving therein a baffle and a locking member. In the case of the preferred embodiment the member is shaped as a wedge insertable with a baffle into a hole and locking the baffle in the hole. In this case the wedge has two working surfaces, that is, one surface, preferably inclined to engage the corresponding inclined surface of the hole and another plane surface to engage the corresponding plane surface of the baffle. It is also advantageous to provide the opposite surface of the hole plane to engage the corresponding surface of the baffle. Such a plane-surface contact of the baffle and the wedge makes for a limited specific pressure and therefore makes is possible to utilize not only baffles of solid refractory material but also baffles of fibrous refractory material.

The plane-surface contact also compensates for the possible shrinkage of the baffles and the upper wall because the wedge need, merely be inserted more or less deeply into the hole. Thus, in the case of two adjacently mounted baffles which are arranged close to each other so as to eliminate any material influence between two successive sections of the kiln, the upper wall of the kiln is provided with a plurality of holes defined by the plane surfaces of the respective wall portions. This hole is designed to receive a row of suspended bricks having two oppositely inclined surfaces facing the plane surfaces of the respective wall portions, defining respective lateral passages between each inclined surface of the suspended brick and the respective plane surface of the wall portion. Each of the passages receives the respective baffles and the wedge to locate the baffle relative to the respective wall portion. The inclined surface of each wedge engages the corresponding inclined surface of the respective suspended brick. Besides the above-mentioned advantages the utilization of wedges as locking members make possible very fast loosening and locking of the baffles which makes the task of replacing the baffles very simple and easy to perform without dismounting any portions of the upper wall, that is, the roof of the kiln. The wedges insure a sealing closure of the holes so as to prevent any gas escape and, therefore, any heat leakage.

The side walls of the kiln between two doubled baffles are provided with at least one orifice to feed therethrough air sufficient to create between these baffles a chamber at a certain pressure sufficient to isolate one sector of the kiln from the next. This is true for both sets of baffles on both walls of the kiln.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
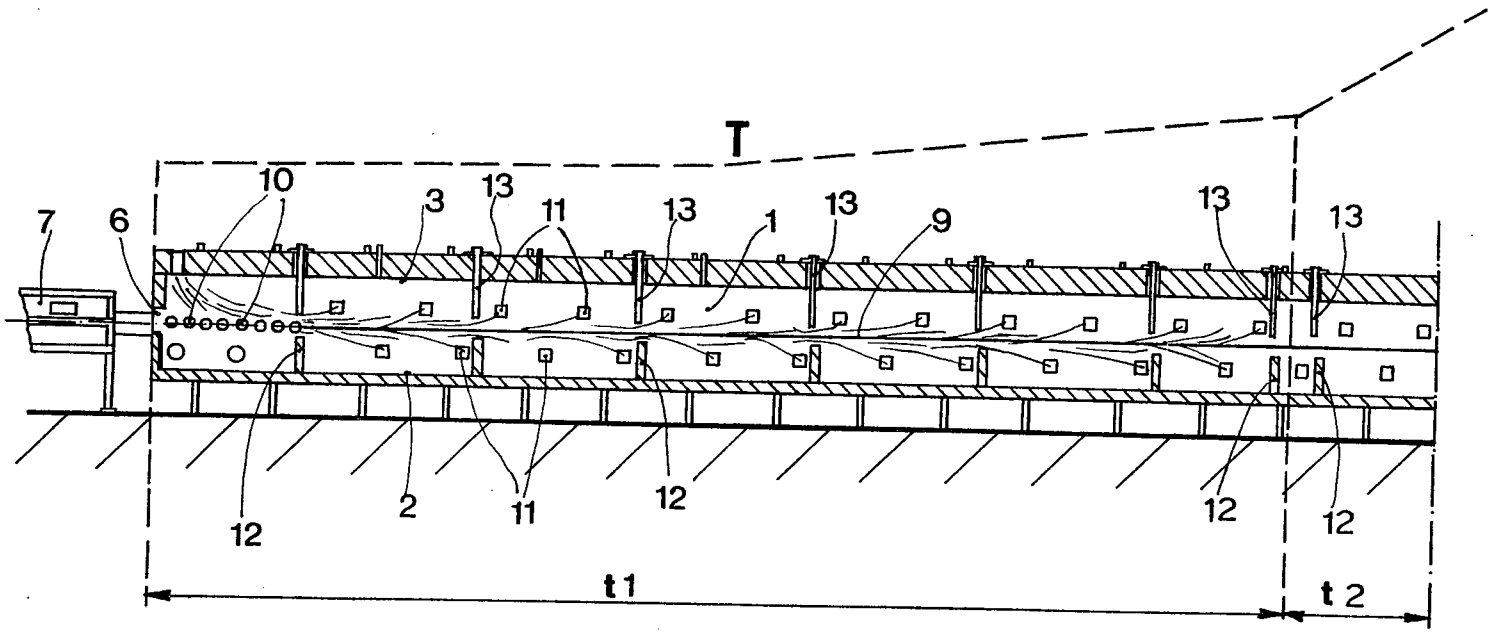
FIG. 1 and FIG. 2 show a sectional longitudinal view of a kiln with the corresponding temperature diagram in accordance with one exemplary embodiment of the present invention.
Figure 2:
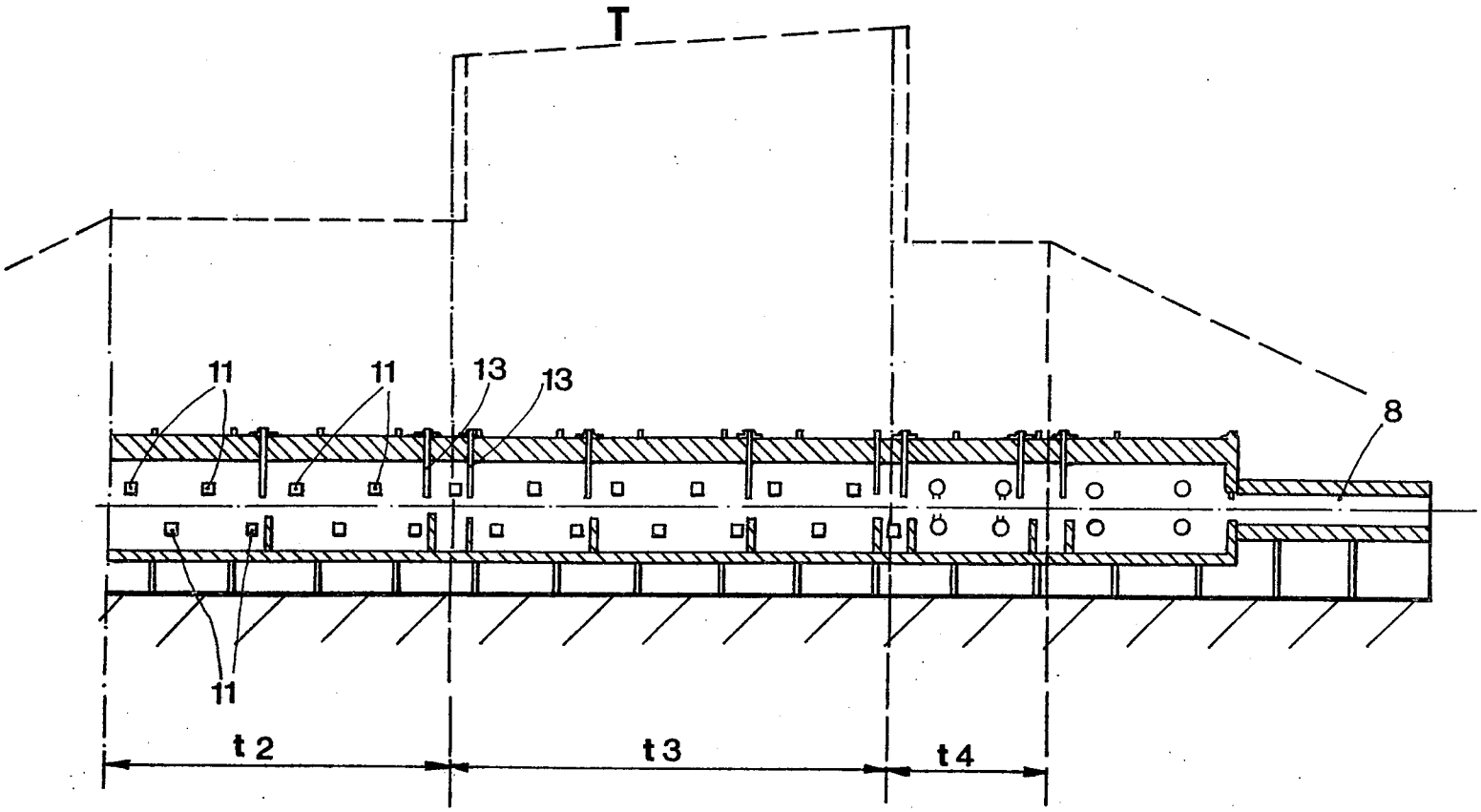
Figure 3:
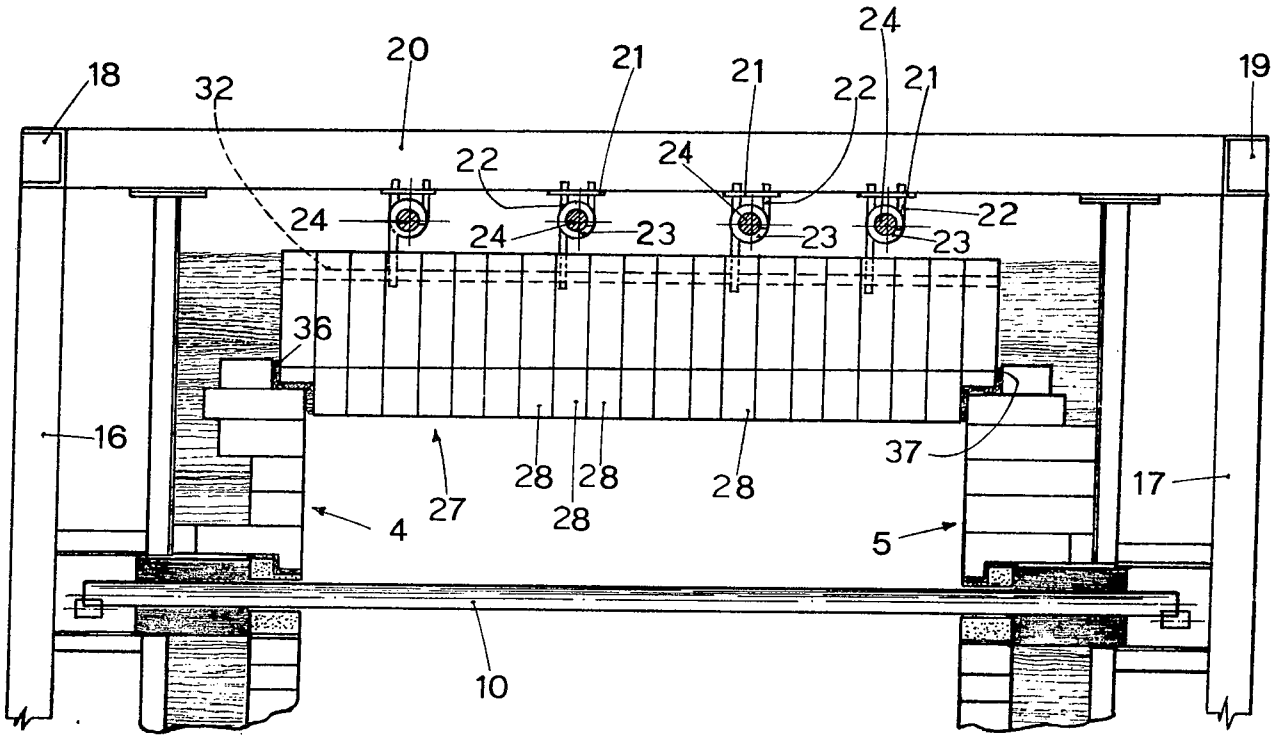
FIG. 3 is a cross-sectional view of a part of the kiln.

Referring now to the drawings and first to FIGS. 1 to 3, it may be seen that the reference numeral 1 designates the tunnel of a roller kiln for ceramic or refractory material. The kiln includes an upper wall 3, a lower wall 2 and side walls 4 and 5.

It is to be mentioned that all walls are clad with refractory material. The housing of the kiln has an inlet 6 for feeding therethrough items to be treated, which emerge from a preklin 7. At the opposite end of the kiln (see FIG. 2) there is provided an outlet 8, where the treated material is usually subject to natural cooling after a final forced cooling operation.

Along the horizontal axis of the kiln, there is provided between the upper and lower walls thereof a passage 9 for items to be treated. The passage 9 comprises a plurality of parallel rollers 10. Each roller, preferably, is a driven roller. The rollers 10 extend transversely to the longitudinal axis of the kiln. The rollers are located with respect to one another so as to prevent the items from falling through the spaces between adjacent rollers. It is also to be mentioned that the rollers 10 are of refractory material, so as to withstand and maintain a sufficient mechanical resistance even at the highest possible temperature in the kiln. The side walls 4 and 5 are provided with a plurality of apertures 11 which open into the interior of the kiln. The apertures 11 are designed to accommodate the fuel burners (not shown) of the kiln.

The kiln is further provided with a plurality of baffles spaced from one another by a substantially regular distance. Thus, the lower wall 2 is provided with the baffles designated in toto by reference numeral 12, which baffles extend from the lower wall 2 towards the upper wall 3. The upper wall 3 is provided with baffles designated by reference numeral 13 and extend from the upper wall 3 towards the lower wall 2. The baffles 13 and 12 of refractory material are spaced from one another along the length of the housing of the kiln so as to bound between them a gap which defines a transport path for the items to be treated. When the items pass between such two opposite baffles 12 and 13 the items are subject to local treatment by the hot gas stream accumulated in the gap between such baffles 12 and 13. Moreover each space limited between two consecutive sets of opposite baffles 12 and 13 may act as a treatment room which may be controlled independently from the others.

In accordance with the present invention at least one of the sets of baffles 12 and 13 (in the preferred embodiment the baffles 13) are adjustable in the direction towards and away from the lower wall 2. This feature renders it possible to vary the width of the transport path, that is the gap between the opposite baffles 12 and 13. Thus the width of the transport path can be adjusted in accordance with the type of items to be treated to obtain the most efficient hot gas concentration for the actual material of the items.

The upper wall of the kiln is provided with a number of throughgoing holes 14 (see FIG. 4) each operative to adjustably receive therein a baffle 13. Each baffle is fixed in the corresponding hole 14 by a wedge 42. One of the working walls of the wedge has an inclined surface which engages the correspondingly inclined surface of the hole 14. The other working wall of the wedge 42 has a vertical plane surface engaging the corresponding plane surface of the baffle 13. When the baffle 13 is arranged at the desired height with respect to the transport path of the kiln the wedge 42 is inserted in the hole so as to urge the baffle 13 against the vertical plane surface of the hole 14. Meanwhile, the inclined surface of the wedge 42 slides along the inclined surface of the hole 14 until the wedge 42 fixedly locates the baffle 13 in the desired position. It is to be understood that the introduction of the wedge 42 in the hole 14 gives at least two distinct advantages which will now be discussed in detail.

In the first place, the baffle 13 can be very easily adjusted or can be removed if necessary for replacement simply by withdrawing the wedge 42 without demounting any portion of the roof. When the baffle is located in the desired position, the latter is maintained by inserting the wedge 42 all the way into the hole 14.

Moreover, the baffle 13 is kept in such a position between the plane surface of the wedge 42 on the one hand and the plane surface of the corresponding brick on the other hand. The plane-surface contact ensures uniform distribution of the pressure along the whole contacting surface of the baffle 13. This fact permits one to utilize not only baffles of solid refractory material but also baffles of soft material, such as refractory fibers, since the pressure exerted on the baffles does not exceed a permissible predetermined level.

Besides that, the wedge 42 renders it possible to compensate for any withdrawal of the baffles 13 without any leakage of the heat from the kiln.

According to the normal distribution of the interior space of the kiln, there are provided a first section t-1, a second section t-2, a third section t-3 and a fourth section t-4. The section t-1 serves for preheating and degassing the material to be treated, that is to remove the flue gases of organic residues from the material. The section t-2 serves for the intermediate step of raising the temperature from that of the preheating step to about the baking value. The section t-3 serves for the baking step during which the temperature is raised to a maximum value (uniform or variable). The step t-4 indicates the forced cooling step at the end of the baking process and the last portion serves for a natural cooling step. In accordance with the present invention each section is separated from the next by a double row of baffles 13 on the upper wall 3 as well as by a double row of baffles 12 on the lower wall 2. The double row of baffles is formed by at least two baffles located near each other so as to define a relatively narrow clearance, which is designed to strongly limit the influence of neighboring steps on one another. This renders it possible to maintain abrupt temperature differences between two successive steps, either an increase or a decrease, without any temperature inertia between these steps. An example of such a temperature variation is presented in the diagram T shown in FIG. 1 and FIG. 2.

Figure 4:
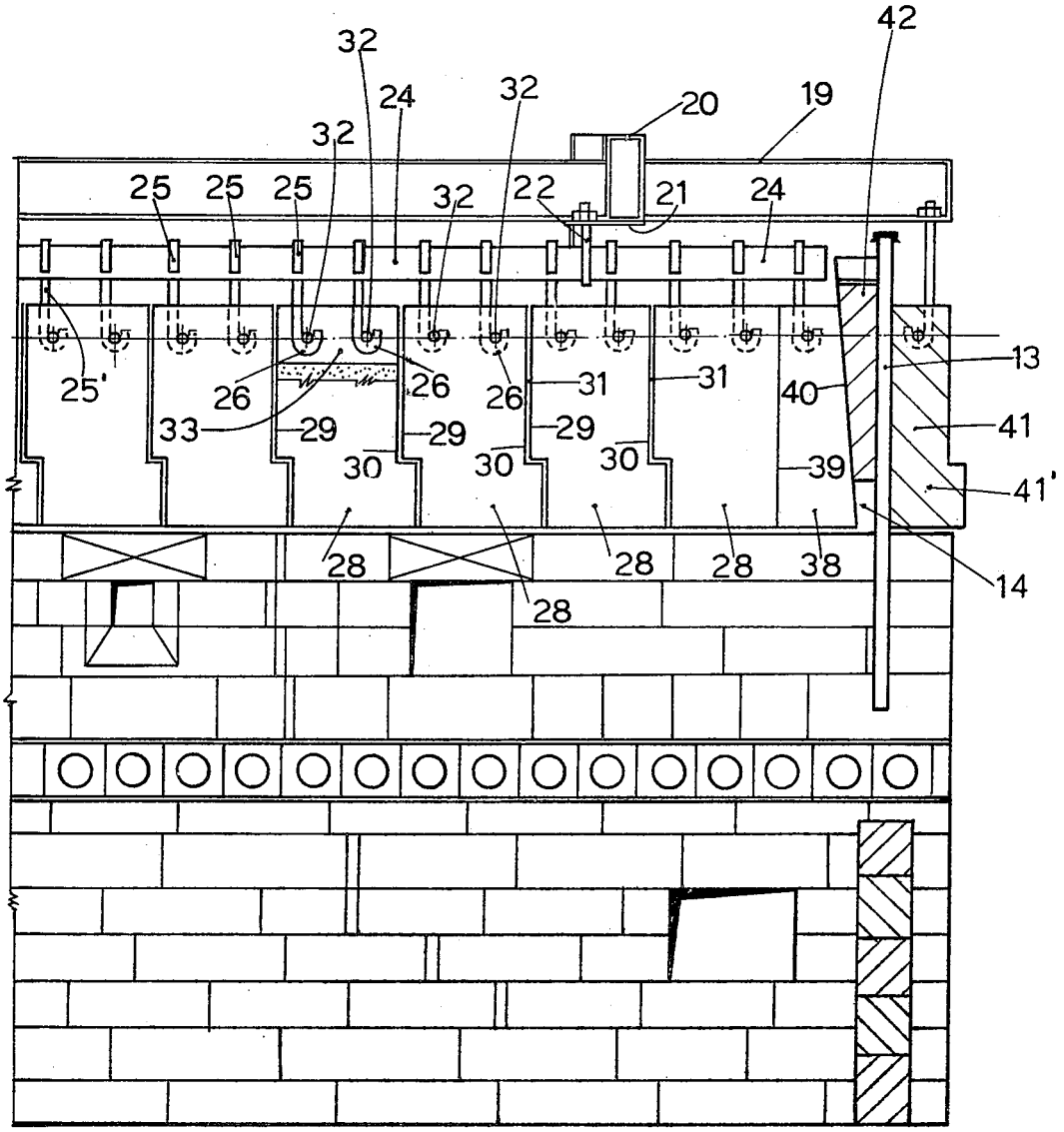
FIG. 4 is a longitudinal section of a part of the kiln.

FIG. 3 and FIG. 4 show a roller kiln with a suspended roof. The kiln is provided with vertical uprights 16 and 17 located at two longitudinal kiln sides and designed to support longitudinal beams 18 and 19 respectively. The beams 18 and 19 support at regular intervals traverses 20 which extend transversely with respect to the longitudinal axis of the kiln. A number of straps 21 is fixed at regular intervals on the traverses 20. The straps 21 are provided with anchored brackets 22. Each of the brackets 22 have a lower portion 23 adapted to support rods 24 extending along the longitudinal axis of the kiln. Elements 25' have hooks 25 which engage the rods 24. The elements 25' further have hooks 26 which extend substantially perpendicular to the bending plane of the hooks 25.

The roof 27 of the kiln comprises transverse rows of bricks 28. The bricks 28 have relatively a narrower dimension transverse to the longitudinal axis of the kiln (see FIG. 3) and a relatively large dimension along the longitudinal axis of the kiln. The connecting surfaces 29 and 30 of the bricks 28 are filled with fibrous refractory material which acts as a thermic seal, so as to prevent any leakage of heat from the kiln. Each of the bricks 28 is provided with two throughgoing holes, which holes when the bricks 25 are assembled define two transversely extending passages which receive two carrying rods 32, which, as already mentioned, are supported with the hooks 25 anchored to the rods 24. The bricks 28 are provided with recesses 33 adapted to accommodate therein the hooks 26 of the elements 25'.

The roof 27 is not supported directly on the side walls 4 and 5 of the kiln, rather on fibrous refractory material packed into labyrinth clearances 36, 37, which form therein seals to prevent any leakage of the hot gases and heat from the kiln.

FIG. 4 shows that the brick 38 which forms with brick 41 the hole 14 is provided with an inclined surface 40 to correspond to the inclined surface of the wedge 42. On the other hand, the brick 41 has one surface plane, that is the surface which engages the corresponding surface of the baffle 13 and another surface having a shoulder 41' which corresponds to a similar shoulder of the successive brick 28 so as to engage the latter, thereby forming the wall.

Figure 5:
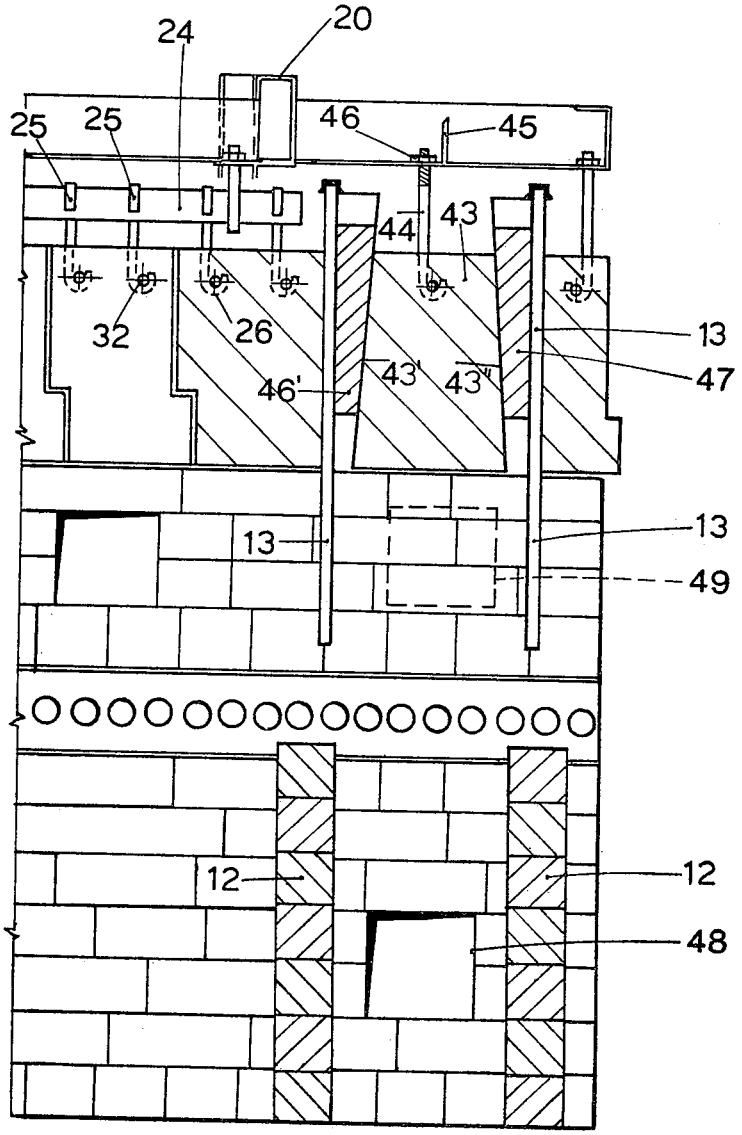
FIG. 5 is a longitudinal section of another part of the kiln.

FIG. 5 shows the arrangement of two adjacent baffles 13 located to separate two successive steps of the kiln.

Between each two baffles 13 there is arranged a spacing brick 43 supported by a respective hook 44 suspended on a beam 45 which extends parallel to the transverse 20. The hook 44 has an end portion which is provided with a thread to engage a nut 46 so as to locate the hook 44 on the horizontal flange of the beam. It is possible to adjust the hook 44 and consequently to vary the position of the brick 43. The brick 43 has side walls 43' and 43'' which are inclined, that is tapered upwardly. Both sides are operative to engage the corresponding inclined surface of the respective wedges 47 and 47', which are similar to the wedge 42.

Such an arrangement makes it possible to adjust the two adjacent baffles 13 independently of each other and still obtain the advantages described with respect to FIG. 4.

The side walls 4 and 5 are provided with openings 49 and 48 between two adjacent baffles 13 and 12, respectively. These openings are operative to feed air therethrough. Preferably, the air introduced through the openings 48 and 49 is combustion air, that is, preheated air. One opening (e.g. 48) is disposed between the baffles 12 under the path of the items, while the other opening (e.g. 49) is disposed between the baffles 13 above the path of the items.

Thus, due to this feature a slight air overpressure is formed between two adjacent baffles which separate two successive sections of the kiln. This assures that no thermal influence will occur between these successive sections. This makes it possible to create completely different temperature regime in two successive sections with abrupt variations of the temperatures thereof. For example, this feature permits a sudden temperature drop from the baking step to the cooling step.

It will be understood that each of the elements described above, or two or more together, may also find a useful application in other types of constructions differing from the types described above.

While the invention has been illustrated and described as embodied in a kiln, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A kiln, comprising a hollow elongated housing having an upper wall and a lower wall spaced from each other defining therebetween the interior of said housing, an inlet for inserting items to be treated in said housing and an outlet for withdrawing the treated items from the housing; a first set of baffles spaced from one another along the length of said housing and mounted on said lower wall of said housing and extending towards said upper wall thereof; a second set of baffles spaced from one another along the length of said housing and mounted on said upper wall of said housing and extending towards said lower wall thereof, said first and second sets of baffles bounding between them a gap extending along the length of said housing, said gap defining a transport path for items to be treated, at least one set of baffles being adjustable so as to vary the width of the gap; and means for transporting the items to be treated through said gap from said inlet to said outlet of said housing.

2. A kiln as defined in claim 1, wherein said transporting means comprise a plurality of rotatable rollers.

3. A kiln as defined in claim 1, said housing having at least two sections of different temperature, said housing further comprising means for preventing any mutual temperature influence between said two sections.

4. A kiln as defined in claim 3, wherein said preventing means comprise at least two baffles adjacently located to each other on each of said walls so as to define a clearance between said baffles on each wall, said clearance having a width measured in direction along the length of the housing sufficient to isolate the different temperatures of two successive sections.

5. A kiln as defined in claim 4, wherein said preventing means further comprise means for creating in said clearance an air overpressure regime adapted to further prevent any mutual temperature influence between said two sections.

6. A kiln as defined in claim 5, wherein said means for creating an air overpressure regime comprise at least one opening heated in each clearance and arranged on the side walls of said housing between said two adjacent baffles and operative for feeding into the clearance a predetermined amount of air at a predetermined pressure sufficient to create in said clearance a relatively slight overpressure sufficient to prevent any mutual temperature influence between said two sections.

7. A kiln as defined in claim 6, wherein said opening is arranged on the side wall between said adjacent baffles of said first set of baffles.

8. A kiln as defined in claim 7, wherein said opening is arranged on the side wall between said adjacent baffles of said second set of baffles.

9. A kiln as defined in claim 1; and further comprising means for adjusting said set of baffles.

10. A kiln as defined in claim 9, wherein at least one of said lower and upper walls is provided with a number of throughgoing holes extending transversely relative to the length of the housing and having one open end communicating with the interior of the housing and another end open outside the housing, each of said holes being adapted to adjustably receive therein one of said adjustable baffles so that a portion of said baffle extends inside the interior of the housing.

11. A kiln as defined in claim 10 wherein said adjusting means comprise a number of wedges each corresponding and adapted to be detachably inserted into a respective hole so as to fixedly locate the corresponding baffle in a desired position in said hole.

* * * * *